US009625839B2

(12) United States Patent
Shishido et al.

(10) Patent No.: US 9,625,839 B2
(45) Date of Patent: Apr. 18, 2017

(54) MULTILAYER ELECTROPHOTOGRAPHIC PHOTOCONDUCTOR AND IMAGE-FORMING APPARATUS

(75) Inventors: Makoto Shishido, Osaka (JP); Kensuke Okawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/338,729

(22) Filed: Dec. 28, 2011

(65) Prior Publication Data

US 2012/0164567 A1 Jun. 28, 2012

(30) Foreign Application Priority Data

Dec. 28, 2010 (JP) ..... 2010-293329

(51) Int. Cl.

| | |
|---|---|
| ***G03G 15/02*** | (2006.01) |
| ***G03G 5/06*** | (2006.01) |
| ***G03G 5/043*** | (2006.01) |
| ***G03G 5/05*** | (2006.01) |

(52) U.S. Cl.

CPC ..... *G03G 5/0696* (2013.01); *G03G 5/043* (2013.01); *G03G 5/0528* (2013.01); *G03G 2215/00957* (2013.01)

(58) Field of Classification Search

CPC ..... G03G 2215/00957; G03G 5/0528; G03G 5/0696; G03G 5/043

USPC ... 430/57.1, 57.2, 57.3, 58.5, 59.4, 59.5, 56, 430/57, 2, 58.05, 58.1; 399/159

See application file for complete search history.

(56) References Cited

U.S. PATENT DOCUMENTS

| | | | | |
|---|---|---|---|---|
| 5,206,359 | A * | 4/1993 | Mayo | C09B 47/067 430/59.5 |
| 5,604,064 | A * | 2/1997 | Nukada et al. | 430/58.65 |
| 7,333,752 | B2 * | 2/2008 | Kawahara et al. | 399/159 |
| 2002/0119388 | A1 * | 8/2002 | Kobayashi | 430/133 |
| 2003/0224268 | A1 * | 12/2003 | Ikuno et al. | 430/57.3 |

(Continued)

FOREIGN PATENT DOCUMENTS

| | | |
|---|---|---|
| JP | 08-176456 | 7/1996 |
| JP | 2007-161992 | 6/2007 |
| JP | 2010-026429 | 2/2010 |

*Primary Examiner* — Christopher Rodee
*Assistant Examiner* — Omar Kekia
(74) *Attorney, Agent, or Firm* — Haug Partners LLP

(57) ABSTRACT

A photosensitive layer in a multilayer electrophotographic photoconductor includes a charge-generation layer including a charge-generating material having, as a major component, a titanyl phthalocyanine crystal which satisfies the conditions (A) and (B) below and a base resin, and a charge-transport layer including a charge-transporting material, the charge-generating material having, as a major component, the titanyl phthalocyanine crystal which has absorption at a wavelength of a charge-neutralizing light and which satisfies the conditions (A) and (B) or an X-form metal-free phthalocyanine crystal which has absorption at the wavelength of the charge-neutralizing light, and a binder resin. (A) In a Cu—Kα characteristic X-ray diffraction spectrum, one peak is present at a Bragg angle 2θ±0.2°=27.2°. (B) In a differential scanning calorimetry, one peak is present in a range of 270° C. to 400° C. except for peaks attributed to vaporization of adsorption water.

6 Claims, 3 Drawing Sheets

(56) References Cited

U.S. PATENT DOCUMENTS

| | | | | |
|---|---|---|---|---|
| 2006/0198659 | A1* | 9/2006 | Niimi | 399/128 |
| 2008/0232850 | A1* | 9/2008 | Shishido | G03G 5/04 399/159 |
| 2009/0257776 | A1* | 10/2009 | Mitsumori et al. | 399/159 |
| 2010/0233603 | A1* | 9/2010 | Hikosaka | 430/70 |

* cited by examiner

MULTILAYER ELECTROPHOTOGRAPHIC PHOTOCONDUCTOR AND IMAGE-FORMING APPARATUS

INCORPORATION BY REFERENCE

This application is based upon and claims the benefit of priority from the corresponding Japanese Patent Applications No. 2010-293329, filed Dec. 28, 2010, the entire contents of which are incorporated herein by reference.

FIELD

The present disclosure relates to a multilayer electrophotographic photoconductor and an image-forming apparatus including the multilayer electrophotographic photoconductor.

BACKGROUND

As electrophotographic photoconductors for use in electrophotographic image-forming apparatuses, inorganic photoconductors having a photosensitive layer composed of inorganic materials, such as selenium, and amorphous silicon, and organic photoconductors having the photosensitive layer mainly composed of organic materials, such as a binder resin, a charge-generating material, and a charge-transporting material, are known.

Among these photoconductors, organic photoconductors have been widely used because, compared with inorganic photoconductors, they are more easily produced, have wider selectivity of materials for the photosensitive layer, and provide for higher design freedom.

Phthalocyanine pigments are widely used as the charge-generating material for such organic photoconductors. In particular, a titanyl phthalocyanine crystal having a Y-type crystal structure has been proposed as the charge-generating material which can improve electrical characteristics of the photoconductors.

On the other hand, the titanyl phthalocyanine having specific physical properties has been proposed as the charge-generating material included in the photosensitive layer of a single-layer electrophotographic photoconductor, the titanyl phthalocyanine having excellent storage stability with respect to organic solvents.

Furthermore, in order to suppress the generation of exposure memory due to a change in surface potential after exposing resulting from an increase in the number of trap sites produced by repeated image formation and to prevent degradation in image characteristics, there has been proposed an electrophotographic photoconductor including at least a charge-generation layer and a charge-transport layer disposed in that order on an electrically conductive support, in which the charge-transport layer includes the charge-generating material having absorption at the wavelength of image exposure light.

SUMMARY

According to an aspect of some embodiments of the present disclosure, a multilayer electrophotographic photoconductor includes an electrically conductive base, and a photosensitive layer disposed on the electrically conductive base. The photosensitive layer has a structure 1) a charge-generation layer including a charge-generating material having, as a major component, the titanyl phthalocyanine crystal which satisfies the conditions (A) and (B) below and a base resin, and a charge-transport layer including (i) a charge-transporting material, (ii) the charge-generating material having, as a major component, the titanyl phthalocyanine crystal which has absorption at a wavelength of a charge-neutralizing light and which satisfies the conditions (A) and (B) below or an X-form metal-free phthalocyanine crystal which has absorption at the wavelength of the charge-neutralizing light, and (iii) a binder resin, the charge-generation layer and the charge-transport layer being stacked in that order, or 2) a first charge-generation layer including the charge-generating material having, as a major component, the titanyl phthalocyanine crystal which satisfies the conditions (A) and (B) below and a base resin, the charge-transport layer including the charge-transporting material and a binder resin, and a second charge-generation layer including (i) the charge-generating material having, as a major component, the titanyl phthalocyanine crystal which has absorption at the wavelength of the charge-neutralizing light and which satisfies the conditions (A) and (B) below or the X-form metal-free phthalocyanine crystal which has absorption at the wavelength of the charge-neutralizing light and (ii) a base resin, the first charge-generation layer, the charge-transport layer, and the second charge-generation layer being stacked in that order.

(A) In a Cu—K$\alpha$ characteristic X-ray diffraction spectrum, one peak is present at a Bragg angle $2\theta \pm 0.2° = 27.2°$.

(B) In a differential scanning calorimetry, one peak is present in a range of 270° C. to 400° C. except for peaks attributed to vaporization of adsorption water.

According to another aspect of some embodiments of the present disclosure, the multilayer electrophotographic photoconductor is used as an image bearing member of an image-forming apparatus which includes the image bearing member, a charging portion operable for charging the surface of the image bearing member, an exposing portion operable for exposing the surface of the image bearing member to form an electrostatic latent image, a developing portion operable for developing the electrostatic latent image to form a toner image, a transferring portion operable for transferring the toner image from the image bearing member to a transfer-receiving medium, and a charge-neutralizing portion operable for neutralizing a charge from the surface of the image bearing member.

According to another aspect of some embodiment of the present disclosure, the image-forming apparatus includes the image bearing member, a charging portion operable for charging the surface of the image bearing member, an exposing portion operable for exposing the surface of the image bearing member to form an electrostatic latent image, a developing portion operable for developing the electrostatic latent image to form a toner image, a transferring portion operable for transferring the toner image from the image bearing member to a transfer-receiving medium, and a charge-removing portion operable for removing a charge from the surface of the image bearing member, in which the image bearing member comprises the multilayer electrophotographic photosensitive member described above.

The above and other objects, features, and advantages of various embodiments of the present disclosure will be more apparent from the following detailed description of embodiments taken in conjunction with the accompanying drawings.

In the text, the terms "comprising", "comprise", "comprises" and other forms of "comprise" can have the meaning ascribed to these terms in U.S. Patent Law and can mean "including", "include", "includes" and other forms of "include." The term "composed" or other forms thereof, as used herein, denotes that some embodiments or implementations may exclude unspecified materials, compounds, elements, components, or the like (e.g., other than, for example, impurities, trace compounds, or the like), and that some embodiments may not exclude other unspecified materials, compounds, elements, components, or the like; for example, other unspecified materials, compounds, elements, may be included provided they do not adversely affect the desired characteristics of the specified material, compound, element, component, or the like, or otherwise do not materially alter the basic and novel characteristics of the embodiment or implementation. The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present embodiments without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

An embodiment relates to a multilayer electrophotographic photoconductor having (i) a charge-generation layer comprising a photosensitive layer that includes the charge-generating material having, as a major component, the titanyl phthalocyanine crystal which satisfies the conditions (A) and (B) below, and (ii) a charge-transport layer that includes the charge-generating material having, as a major component, (a) the titanyl phthalocyanine crystal which has absorption at the wavelength of the charge-neutralizing light and which satisfies the conditions (A) and (B) below or (b) the X-form metal-free phthalocyanine crystal which has absorption at the wavelength of the charge-neutralizing light, in which (A) in a Cu—K$\alpha$ characteristic X-ray diffraction spectrum, one peak is present at a Bragg angle $2\theta \pm 0.2° = 27.2°$, and (B) in a differential scanning calorimetry, one peak is present in a range of 270° C. to 400° C. except for peaks attributed to vaporization of adsorption water.

In general, there are two types of electrophotographic photoconductor, i.e., single-layer type and multilayer type. The electrophotographic photoconductor according to embodiments of the present disclosure is a multilayer electrophotographic photoconductor.

The multilayer electrophotographic photoconductor according to an illustrative embodiment will be described below.

Figure 1A:
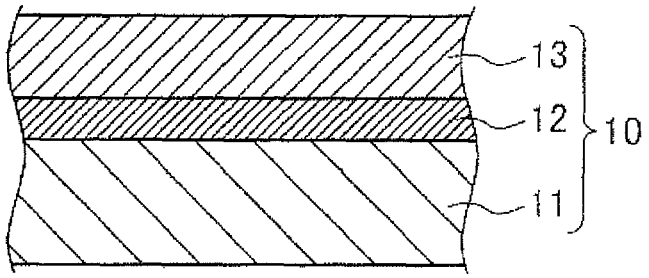
FIGS. 1A and 1B illustrate structure of multilayer electrophotographic photoconductors according to some embodiments of the present disclosure.
Figure 1B:
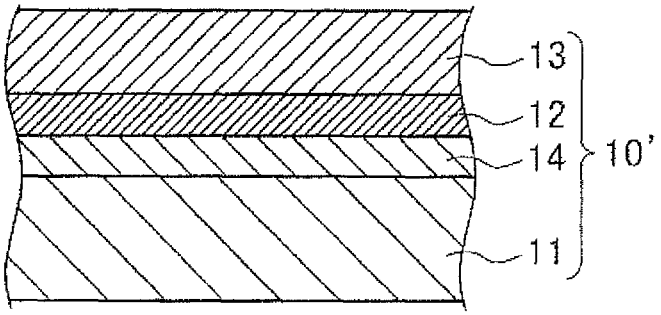

FIGS. 1A and 1B show multilayer electrophotographic photoconductors 10 and 10', respectively, according to some embodiments.

As shown in FIG. 1A, the multilayer electrophotographic photoconductor 10 includes an electrically conductive base 11, and a charge-generation layer 12 and a charge-transport layer 13, layers 12 and 13 constituting the photosensitive layer and being disposed in that order on the electrically conductive base 11.

In the multilayer electrophotographic photoconductor 10, the charge-transport layer 13 corresponds to a surface layer.

By appropriately selecting the type of the charge-transporting material, the multilayer electrophotographic photoconductor 10 can be applied to either a positively or negatively charging method.

Furthermore, as shown in FIG. 1B, the multilayer electrophotographic photoconductor 10 according to some embodiments has a structure in which an undercoat layer 14 and the charge-generation layer 12 and the charge-transport layer 13, which constitute the photosensitive layer, are disposed in that order on an electrically conductive base 11.

Some reasons for providing the undercoat layer 14 are that, in some implementations, charges on the side of the electrically conductive base 11 can be prevented from entering the photosensitive layer, binding of the photosensitive layer to the electrically conductive base 11 can be strengthened, and the surface of the electrically conductive base 11 can be smoothed by covering surface defects.

Regarding the multilayer electrophotographic photoconductor, the electrically conductive base and the photosensitive layer according to some embodiments will be described below in that order.

The electrically conductive base used in the multilayer electrophotographic photoconductor is not particularly limited as long as it can be used as an electrically conductive base of an electrophotographic photoconductor.

Specific examples thereof according to some embodiments include the electrically conductive base being composed of an electrically conductive material, or the electrically conductive base having a structure in which the surface of a body composed of a plastic material or the like is covered with an electrically conductive material.

Examples of the electrically conductive material in accordance with some embodiments include aluminum, iron, copper, tin, platinum, silver, vanadium, molybdenum, chromium, cadmium, titanium, nickel, palladium, indium, stainless steel, and brass.

Furthermore, as the electrically conductive material, one kind may be used, or two or more kinds may be used in combination, for example, as an alloy or the like.

Among the materials described above, the electrically conductive base according to some embodiments is preferably composed of aluminum or an aluminum alloy.

A possible reason for preferred images possibly being provided by some implementations of a photoconductor employing an aluminum or aluminum alloy conductive base is that, in some implementations, using such a conductive base provides for charges being efficiently transferred from the photosensitive layer to the electrically conductive base.

The shape of the electrically conductive base can be selected appropriately in accordance with the structure of an image-forming apparatus to be used. For example, a sheet-like base, a drum-like base, or the like can be used in some embodiments.

The photosensitive layer of the multilayer electrophotographic photoconductor according to the present illustrative embodiment is produced by stacking the charge-generation layer and the charge-transport layer in that order, in which the charge-generation layer includes the charge-generating material having, as a major component, the titanyl phthalocyanine crystal which satisfies the conditions (A) and (B) described above and a base resin, and the charge-transport layer includes the charge-transporting material, the charge-generating material having, as a major component, the titanyl phthalocyanine crystal which has absorption at the wavelength of the charge-neutralizing light and which satisfies the conditions (A) and (B) described above or the X-form metal-free phthalocyanine crystal which has absorption at the wavelength of the charge-neutralizing light, and a binder resin. Regarding the photosensitive layer of the multilayer electrophotographic photoconductor according to some embodiments of the present disclosure, the charge-transport layer, which is the surface layer, will be described below, followed by description of the charge-generation layer.

In some embodiments, the charge-transport layer constituting the photosensitive layer of the multilayer electrophotographic photoconductor includes, in addition to the charge-transporting material, a predetermined charge-generating material in order to suppress the exposure memory generated in the transfer step in the image formation process.

That is, the charge-transport layer constituting the photosensitive layer of the multilayer electrophotographic photoconductor according to some embodiments of the present disclosure includes the charge-transporting material and the charge-generating material. Thus, the charge generated in the charge-generation layer can be transported, and the exposure memory generated in the transfer step in the image formation process can be suppressed.

For purposes of clarity of exposition, an example of the exposure memory generated in the transfer step in the image formation process will be described using, as an example, a case of a multilayer electrophotographic photoconductor.

In general, an image formation process using an electrophotographic method includes a charging step, an exposure step, a development step, a transfer step, a charge neutralizing step, and the like.

In the first charging step, the surface of the multilayer electrophotographic photoconductor, i.e., the surface of the image bearing member, is uniformly electrically charged to a certain electrostatic potential such that the surface has a positive or negative charge.

Next, in the exposure step, the surface of the multilayer electrophotographic photoconductor which has been uniformly charged to a certain potential is exposed, and an electrostatic latent image is formed on the exposed area.

In the development step, a toner is electrostatically attached to the exposed area to form a toner image, and thus the electrostatic latent image is made visible. In the transfer step, the toner image formed on the surface of the multilayer electrophotographic photoconductor is transferred to an intermediate transfer member.

In the step in which the toner image is transferred to the intermediate transfer member, a bias having a polarity opposite to that of the surface charge of the multilayer electrophotographic photoconductor is applied to the intermediate transfer member.

When the bias having a polarity opposite to that of the surface charge of the multilayer electrophotographic photoconductor is applied to the intermediate transfer member, the exposed area maintains the polarity at the time of charging, even when applied with the bias having the opposite polarity, because the exposed area has the toner constituting the toner image on the surface thereof.

However, a non-exposed area of the photoconductor does not have the toner constituting the toner image on the surface thereof, and therefore, the non-exposed area has a charge having a polarity opposite to that of the surface charge of the photoconductor because of the applied bias having the opposite polarity.

As a result, the exposed area and the non-exposed area on the multilayer electrophotographic photoconductor have potentials having different polarities, and the difference in potential causes generation of exposure memory in the subsequent image formation process.

Accordingly, in accordance with embodiments of the present disclosure, the charge with opposite polarity of the non-exposed area, which results in the generation of exposure memory, is neutralized (or substantially neutralized) by the charge generated from the charge-generating material included in the charge-transport layer to eliminate (or substantially reduce) the difference in potential, and thus the exposure memory generated in the transfer step is suppressed (e.g., eliminated or substantially reduced).

That is, the charge-generating material included in the charge-transport layer absorbs the energy of light applied in the image formation process to generate a charge.

It is believed that the generated charge neutralizes the charge with opposite polarity present in the non-exposed area of the surface of the multilayer electrophotographic photoconductor, thus suppressing generation of exposure memory.

Usually, the charge-transport layer of a multilayer electrophotographic photoconductor is required not to prevent absorption of light arriving in the charge-generation layer.

Consequently, the charge-transport layer in a commonly used multilayer electrophotographic photoconductor does not include the charge-generating material.

In contrast, the charge-transport layer of the multilayer electrophotographic photoconductor according to embodiments of the present disclosure is made to include the charge-generating material in order to neutralize the charge in the surface of the multilayer electrophotographic photoconductor, which charge results in the generation of exposure memory, using the energy of light applied in the image formation process.

In accordance with some embodiments, the charge-generating material included in the charge-transport layer has, as a major component, (i) the titanyl phthalocyanine crystal which has absorption at the wavelength of the charge-neutralizing light used in the charge removal step in the image formation process and which satisfies the conditions (A) and (B) described above or (ii) the X-form metal-free phthalocyanine crystal which has absorption at the wavelength of the charge-neutralizing light.

Since in various implementations of the charge-generating material it does not cause crystal transformation in the application liquid for formation of the charge-transport layer, it is possible to prevent generation of exposure memory, and it is possible to prevent degradation in image characteristics and electrical characteristics.

The charge-generating material absorbs the energy of light applied in the charge neutralizing step to generate a charge, and it is believed the generated charge neutralizes the charge with opposite polarity present in the non-exposed area that (if not neutralized) results in the generation of exposed memory.

The charge-generating material has absorption at the wavelength of the charge-neutralizing light, and has an absorbance such that the absorbance of the charge-transport layer including the charge-generating material is, for example, about 0.001 to about 0.85 with respect to the wavelength of the charge-neutralizing light.

In accordance with some implementations, when the absorbance of the charge-transport layer including the charge-generating material is 0.001 or more, it is possible to generate a charge sufficient to neutralize the charge with opposite polarity present in the non-exposed area on the surface of the multilayer electrophotographic photoconductor, which is preferable according to some embodiments.

In accordance with some implementations, when the absorbance is 0.85 or less, absorption of light used for exposure of the charge-generation layer is not hindered, which is preferable according to some embodiments.

That is, the charge-generating material included in the charge-transport layer has large absorption at the wavelength of the charge-neutralizing light that is applied in the charge removal step and can generate a sufficient charge so that the charge generated from the charge-generating material included in the charge-transport layer can effectively neutralize the charge with opposite polarity generated in the transfer step in the image formation process. For example, depending on the implementation, effectively neutralizing such charge may neutralize all or nearly all such charge, or may neutralize only at least a sufficient amount of such charge so as to eliminate or substantially reduce deleterious effects associated with the generation of exposed memory.

In accordance with some embodiments, the amount of the charge-generating material included in the charge-transport layer is preferably about 0.001 to about 1.0 part by mass relative to 100 parts by mass of the binder resin in the charge-transport layer.

In some implementations, when the amount of the charge-generating material is about 0.001 parts by mass or more, it is possible to generate a charge sufficient to neutralize the charge present in the non-exposed area in the surface of the multilayer electrophotographic photoconductor, which is preferable according to some embodiments.

In some implementations, when the amount is about 1.0 part by mass or less, absorption of light used for exposure of the charge-generation layer is not hindered, which is preferable according to some embodiments.

The charge-generating material may be used alone or two or more kinds of charge-generating materials may be used in combination so as to have absorption with respect to the light applied in the charge removal step in the image formation process.

For example, the charge-generating material may be used alone or two or more kinds of charge-generating materials may be used in combination so as to have absorption at the wavelength of the charge-neutralizing light used in the charge removal step and in such a manner that the absorbance of the charge-transport layer including the charge-generating material is about 0.001 to about 0.85.

From the standpoint of long-term storability in the solvent used for the application liquid for formation of charge-transport layer when the charge-transport layer is formed, the charge-generating material must, according to some embodiments, include the titanyl phthalocyanine crystal which has absorption at the wavelength of the charge-neutralizing light and which satisfies the conditions (A) and (B) described above or the X-form metal-free phthalocyanine crystal which has absorption at the wavelength of the charge-neutralizing light.

The specific method for measuring the Bragg angle in the condition (A) and the differential scanning calorimetry method in the condition (B) will be described in detail in the below Examples following further description of the present illustrative embodiments.

The charge-generating material having, as a major component, the titanyl phthalocyanine crystal which has absorption at the wavelength of the charge-neutralizing light and which satisfies the conditions (A) and (B) described above or the X-form metal-free phthalocyanine crystal which has absorption at the wavelength of the charge-neutralizing light is according to some embodiments, stable in the application liquid for formation of charge-transport layer including a binder resin used when the charge-transport layer is formed. Consequently, when the charge-transport layer including the charge-generating material is formed, the charge-generating material can be directly incorporated into the charge-transport layer without using an application liquid for formation of charge-generation layer.

That is, in some embodiments it is possible to form the charge-transport layer without using a base resin.

In the illustrative embodiment, the charge-transport layer of the photosensitive layer constituting the multilayer electrophotographic photoconductor includes, in addition to the charge-generating material which has absorption at the wavelength of the charge-neutralizing light, the charge-transporting material and a binder resin as in the commonly used charge-transport layer.

The charge-transporting material is not particularly limited as long as it can be used as the charge-transporting material included in the photosensitive layer of an electrophotographic photoconductor.

Examples of the charge-transporting material include a hole-transporting material which transports positive charges and an electron-transporting material which transports negative charges.

In the case of a negatively charging type multilayer electrophotographic photoconductor, the hole-transporting material is used as the charge-transporting material, and in the case of a positively charging type multilayer electrophotographic photoconductor, the electron-transporting material is used as the charge-transporting material.

Examples of the hole-transporting material that can be used include nitrogen-including cyclic compounds and condensed polycyclic compounds, such as benzidine derivatives, oxadiazole compounds (e.g., 2,5-di(4-methylaminophenyl)-1,3,4-oxadiazole), styryl compounds (e.g., 9-(4-diethylaminostyryl)anthracene), carbazole compounds (e.g., polyvinylcarbazole), organic polysilane compounds, pyrazoline compounds (e.g., 1-phenyl-3-(p-dimethylaminophenyl)pyrazoline), hydrazone compounds, triphenylamine compounds, indole compounds, oxazole compounds, isoxazole compounds, triazole compounds, thiadiazole compounds, imidazole compounds, pyrazole compounds, and triazole compounds. Among these, triphenylamine compounds are preferable in some embodiments.

The electron-transporting material that can be used is not particularly limited as long as it can be used as an electron-transporting material included in the photosensitive layer of an electrophotographic photoconductor.

Specific examples according to some embodiments thereof include quinone derivatives, such as naphthoquinone derivatives, diphenoquinone derivatives, anthraquinone derivatives, azoquinone derivatives, nitroanthraquinone derivatives, and dinitroanthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromomaleic anhydride.

Among these, quinone derivatives are more preferable in some embodiments.

The binder resin is not particularly limited as long as it can be used as a binder resin in a multilayer electrophotographic photoconductor.

Specifically, various resins can be used, and examples thereof include olefin polymers, such as styrene-based polymers, acrylic polymers, styrene-acrylic polymers, ethylene-vinyl acetate copolymers, polypropylenes, and ionomers; and photocurable resins, such as polyvinyl chloride-vinyl acetate copolymers, polyesters, alkyd resins, polyurethanes, epoxy resins, polycarbonates, polyarylates, polysulfones, diallyl phthalate resins, silicone resins, ketone resins, polyether resins, phenolic resins, and epoxy acrylates.

These resins may be used alone or two or more types of resins may be used in combination.

Among them, polycarbonate resins are particularly preferable in some embodiments.

The method for producing the binder resin is not particularly limited. The binder resin can be produced, for example, in accordance with a known method for producing a polycarbonate resin.

The charge-generation layer of the multilayer electrophotographic photoconductor according to some embodiments includes the charge-generating material having, as a major component, the titanyl phthalocyanine crystal which satisfies the conditions (A) and (B) described above.

The multilayer electrophotographic photoconductor according to some embodiments of the present disclosure is provided with the photosensitive layer in which the charge-generation layer including the charge-generating material having, as a major component, the titanyl phthalocyanine crystal which has predetermined optical characteristics and thermal characteristics satisfying the conditions (A) and (B) described above and the charge-transport layer including the charge-generating material having, as a major component, the titanyl phthalocyanine crystal which has absorption at the wavelength of the charge-neutralizing light and which has predetermined optical characteristics and thermal characteristics or the X-form metal-free phthalocyanine crystal which has absorption at the wavelength of the charge-neutralizing light are combined.

As a result, by suppressing the exposure memory generated in the transfer step in the image formation process, it is possible to provide a good image (e.g., an improved image compared to known multilayer electrophotographic photoconductors).

The charge-generation layer includes the charge-generating material and a base resin.

In a multilayer photoconductor, usually, the charge-generation layer and the charge-transport layer are stacked in that order, and therefore, a resin different from the binder resin is selected as the base resin so that the base resin is not dissolved in an application solvent for the charge-transport layer.

Specific examples of the base resin according to some embodiments include styrene-butadiene copolymers, styrene-acrylonitrile copolymers, styrene-maleic acid copolymers, acrylic copolymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, polyurethane resins, polysulfone resins, diallyl phthalate resins, ketone resins, polyvinyl acetal resins, polyvinyl butyral resins, polyether resins, silicone resins, epoxy resins, phenolic resins, urea resins, melamine resins, epoxy acrylate resins, and urethane-acrylate resins.

These resins may be used alone or two or more types of resins may be used in combination as the base resin for the charge-generation layer.

The photosensitive layer in a multilayer electrophotographic photoconductor is produced by stacking the charge-generation layer and the charge-transport layer in that order on an electrically conductive base or on an undercoat layer formed on an electrically conductive base.

In some embodiments, the thickness of the charge-generation layer is preferably about 0.1 to about 5 μm, and more preferably about 0.1 to about 3 μm.

In some embodiments, the thickness of the charge-transport layer is preferably about 2 to about 100 μm, and more preferably about 10 to about 50 μm The content of the charge-generating material in the charge-generation layer is not particularly limited as long as the object of the present disclosure is not impaired.

In some embodiments, the charge-generation layer is formed by application of an application liquid, the amount of the charge-generating material is preferably about 10 to about 500 parts by mass, and more preferably about 30 to about 200 parts by mass, relative to 100 parts by mass of the base resin.

In some embodiments, the charge-transporting material in the charge-transport layer is preferably about 30 to about 200 parts by mass relative to 100 parts by mass of the binder resin.

In some implementations, when the content of the charge-transporting material is 30 parts by mass or more, the charge-transporting material functions satisfactorily and sensitivity improves, which is preferable according to some embodiments.

In some implementations, when the content is about 200 parts by mass or less, the charge-transporting material is prevented from being crystallized in the binder resin of the charge-generation layer, and excellent abrasion resistance is exhibited, which is preferable according to some embodiments.

In some embodiments, the content of the charge-generating material in the charge-transport layer is preferably about 0.001 to about 1.0 part by mass relative to 100 parts by mass of the binder resin in the charge-transport layer.

In some implementations, when the content of the charge-generating material is about 0.001 parts by mass or more, a sufficient amount of charges can be generated in the surface of the charge-transport layer, which is preferable according to some embodiments.

In some implementations, when the content is about 1.0 part by mass or less, absorption of light used for exposure of the charge-generation layer is not inhibited, which is preferable according to some embodiments.

As the method of forming the charge-generation layer, from the standpoint that an expensive vapor deposition apparatus is not needed and the film-forming operation is easy, application of an application liquid for formation of charge-generation layer including at least the charge-generating material, a base resin, and a solvent is preferable according to some embodiments.

As the method of forming the charge-transport layer, application of an application liquid for formation of charge-transport layer including at least the charge-transporting material, a binder resin, the charge-generating material, and a solvent may be used.

As the solvent used for preparing the application liquid for formation of charge-generation layer or formation of charge-transport layer, various conventional organic solvents can be used, but a solvent that does not dissolve the previously applied layer is selected when the photosensitive layer is formed by stacking.

Specific examples thereof according to some embodiments include alcohols, such as methanol, ethanol, isopropanol, and butanol; aliphatic hydrocarbons, such as n-hexane and octane; aromatic hydrocarbons, such as benzene, toluene, and xylene; halogenated hydrocarbons, such as dichloromethane, dichloroethane, chloroform, carbon tetrachloride, and chlorobenzene; ethers, such as dimethyl ether, diethyl ether, tetrahydrofuran, dioxane, dioxolane, ethylene glycol dimethyl ether, and diethylene glycol dimethyl ether; ketones, such as acetone, methyl ethyl ketone, methyl isobutyl ketone, butanone, and cyclohexanone; esters, such as ethyl acetate and methyl acetate; and aprotic polar organic solvents, such as N,N-dimethylformaldehyde, N,N-dimethylformamide, and dimethylsulfoxide.

Various known additives can be added to the application liquids within the range that does not adversely affect the characteristics of the multilayer electrophotographic photoconductor.

Examples of additives to be added to the application liquids include anti-degradation materials, such as antioxidants, radical scavengers, singlet quenchers, and ultraviolet absorbers; softeners; plasticizers; surface modifiers; extenders; thickening materials; dispersion stabilizers; waxes; acceptors; and donors.

Furthermore, in order to improve the dispersibility of the charge-transporting material or the charge-generating material and the smoothness of the surface of the photosensitive layer, a surfactant, a leveling material, or the like may be used.

The method for applying the application liquids is not particularly limited. For example, a method using a spin coater, an applicator, a spray coater, a bar coater, a dip coater, a doctor blade, or the like may be used.

The films formed by applying the application liquids described above are each dried using a high-temperature dryer, a reduced-pressure dryer, or the like to remove the solvent, and thereby the charge-generation layer and the charge-transport layer are obtained. The drying temperature is, according to some implementations, preferably about 40° C. to about 150° C.

By drying the films of the application liquids in such a temperature range, the solvent is rapidly removed, and the charge-generation layer and the charge-transport layer each with a uniform thickness can be formed efficiently.

When the drying temperature is too high, the component, such as the charge-transporting material, included in the photosensitive layer may be thermally decomposed, which is not desirable.

In addition, in the case where an undercoat layer is formed on the electrically conductive base, an application liquid for formation of undercoat layer is prepared using a resin, inorganic fine particles of zinc oxide, titanium oxide, or the like, and a solvent, and by applying the application liquid onto the electrically conductive base, followed by drying, an undercoat layer can be formed.

Although the present disclosure has been specifically described on the basis of the hereinabove illustrative embodiment, the present disclosure is not limited to the embodiment, and modifications can be made appropriately within the scope of the present disclosure.

For example, in accordance with some embodiments such as described hereinabove (e.g., in connection with FIGS. 1A and 1B), the photosensitive layer has a two-layered structure in which the charge-generation layer and the charge-transport layer including the charge-transporting material, a binder resin, and the charge-generating material are stacked in that order.

It may also be possible, for example, to form the photosensitive layer having a three-layered structure including the first charge-generation layer, the charge-transport layer, and a second charge-generation layer, in which the charge-transport layer does not include the charge-generating material.

That is, the photosensitive layer of an electrophotographic photoconductor in an illustrative modification example has a three-layered structure in which the charge-generation layer that is the same as that of the multilayer electrophotographic photoconductor in the hereinabove described embodiment (i.e., with respect to FIGS. 1A and 1B) is used as the first charge-generation layer, and the charge-transport layer including the charge-transporting material and a binder resin, but not including the charge-generating material, and a second charge-generation layer including the charge-generating material and a base resin are stacked on the first charge-generation layer.

In such a modification example, the second charge-generation layer includes the charge-generating material which is the same as that included in the charge-transport layer of the photosensitive layer according to the embodiment described above.

In some embodiments, the content of the charge-generating material in the second charge-generation layer of the electrophotographic photoconductor is about 0.001 to about 1.0 part by mass relative to 100 parts by mass of the base resin.

Furthermore, in some implementations, the second charge-generation layer has an absorbance of about 0.001 to about 0.85 with respect to the wavelength of the charge-neutralizing light.

Figure 2A:
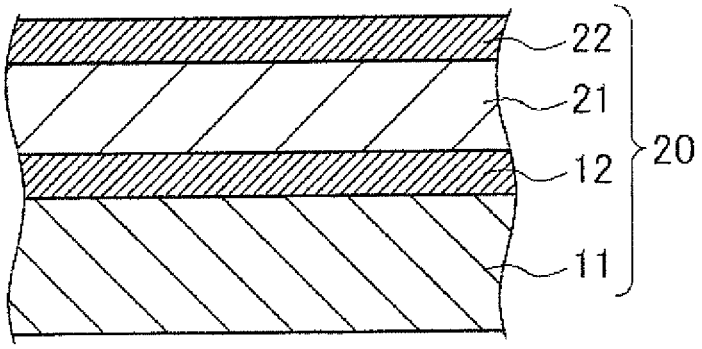
FIGS. 2A and 2B illustrate structure of multilayer electrophotographic photoconductors according to some embodiments of the present disclosure.
Figure 2B:
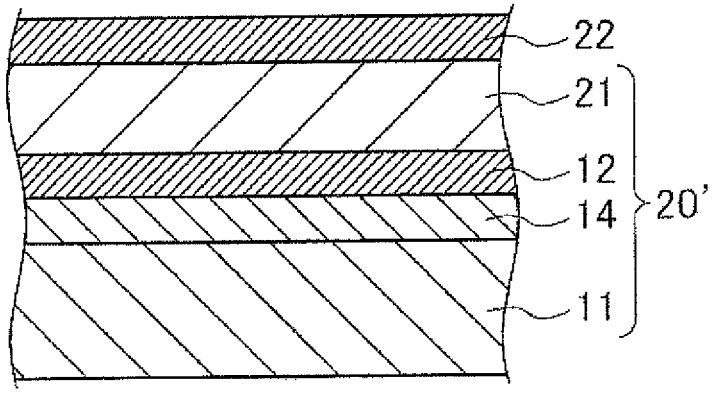

FIGS. 2A and 2B show multilayer electrophotographic photoconductors 20 and 20' as examples of some modifications of the multilayer electrophotographic photoconductor according to various embodiments of the present disclosure.

As shown in FIG. 2A, the multilayer electrophotographic photoconductor 20 includes the photosensitive layer including a first charge-generation layer 12, the charge-transport layer 21, and a second charge-generation layer 22 including the charge-generating material having, as a major component, the titanyl phthalocyanine crystal which has absorption at the wavelength of the charge-neutralizing light and which has predetermined optical characteristics and thermal characteristics or the X-form metal-free phthalocyanine crystal which has absorption at the wavelength of the charge-neutralizing light, the first charge-generation layer 12, the charge-transport layer 21, and the second charge-generation layer 22 being stacked in that order on an electrically conductive base 11.

In the multilayer electrophotographic photoconductor 20 including the photosensitive layer described above, since the second charge-generation layer 22, i.e., the surface layer, includes the charge-generating material which has absorption at the wavelength of the charge-neutralizing light, the same advantageous effects as those of the foregoing embodiments (e.g., described with reference to FIGS. 1A and 1B) can be obtained.

In the multilayer electrophotographic photoconductor 20' shown in FIG. 2B, the first charge-generation layer 12 is disposed on an electrically conductive base 11 with an undercoat layer 14 therebetween, and the charge-transport layer 21 and a second charge-generation layer 22 are stacked thereon in that order, thus constituting the photosensitive layer.

Some embodiments of the present disclosure also relates to the image-forming apparatus including the image bearing member, a charging portion operable for charging the surface of the image bearing member, an exposing portion operable for exposing the surface of the image bearing member to form an electrostatic latent image, a developing portion operable for developing the electrostatic latent image to form a toner image, a transferring portion operable for transferring the toner image from the image bearing member to a transfer-receiving medium, and a charge-neutralizing portion operable for neutralizing the surface charge of the image bearing member.

The image-forming apparatus according to the present disclosure can be applied to both a monochrome image-forming apparatus and a color image-forming apparatus. Here, by way of example according to some embodiments, description will be made on a tandem color image-forming apparatus which uses a plurality of color toners.

The image-forming apparatus according to this embodiment includes a plurality of image bearing members arranged in order in a predetermined direction so that different color toner images are formed on the surfaces of the image bearing members, and a plurality of developing portions arranged so as to face their corresponding image bearing members, the developing portions each being provided with a development roller which supports a toner on the surface thereof, transports the toner, and supplies the transported toner to the surface of the corresponding image bearing member.

As the image bearing members, multilayer electrophotographic photoconductors according to the embodiments described hereinbove (e.g., with reference to FIGS. 1A and 1B, or with reference to FIGS. 2A and 2B) are used.

Figure 3:
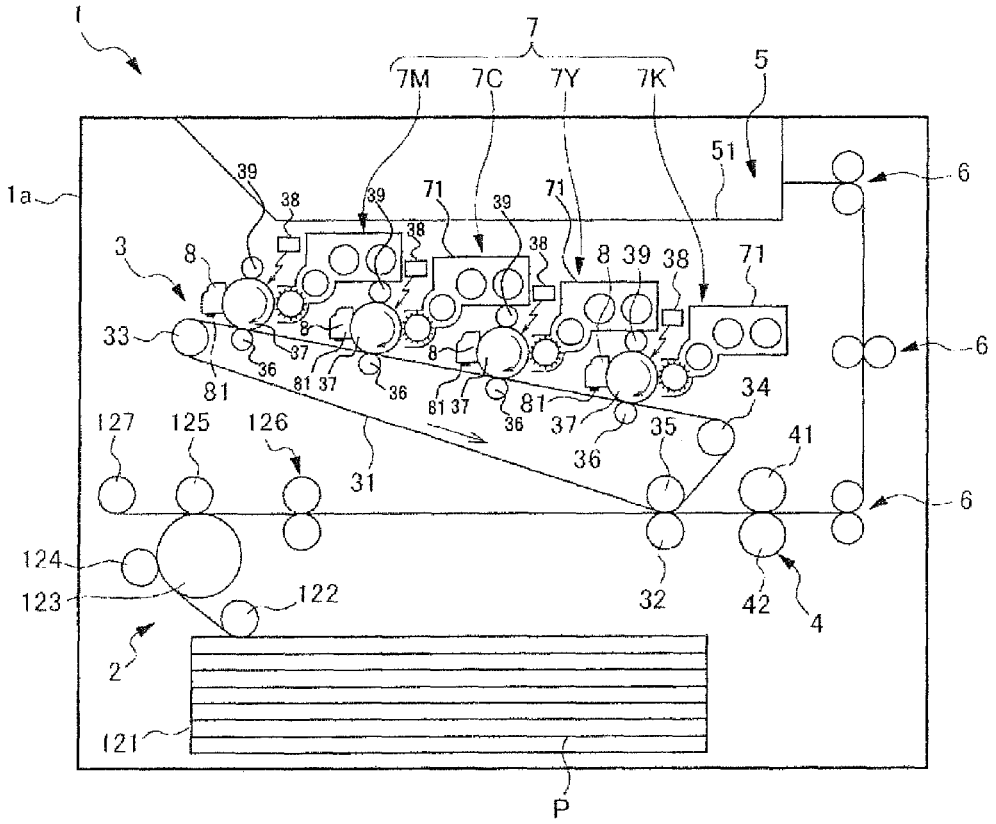
FIG. 3 is a schematic diagram illustrating an image-forming apparatus according to some embodiments of the present disclosure.

FIG. 3 is a schematic view showing a structure of a color image-forming apparatus of tandem type provided with multilayer electrophotographic photoconductors according to the embodiment of the present disclosure.

As shown in FIG. 3, a color printer 1 has a box-shaped apparatus main body 1*a* and includes, inside the apparatus main body 1*a*, a paper feeding section 2 which feeds a sheet P, an image-forming section 3 which transfers toner images based on image data and the like to the sheet P while transporting the sheet P fed from the paper feeding section 2, and a fixing section 4 which fixes unfixed toner images, which have been transferred by the image-forming section 3 to the sheet P, on the sheet P.

Furthermore, a paper ejection section 5 is provided on the upper surface of the apparatus main body 1*a*, into which the sheet P subjected to fixing treatment in the fixing section 4 is ejected.

The paper feeding section 2 includes a paper feed cassette 121, a pick-up roller 122, paper feed rollers 123, 124, and 125, and a registration roller 126.

The paper feed cassette 121 is detachably provided to the apparatus main body 1*a* and stores sheets P of various sizes.

The pick-up roller 122 is located on the upper left position of the paper feed cassette 121 as shown in FIG. 3, and picks up the sheets P stored in the paper feed cassette 121 one by one.

The paper feed rollers 123, 124, and 125 send the sheet P picked up by the pick-up roller 122 to a sheet transport path.

The registration roller 126 temporarily holds the sheet P sent to the sheet transport path by the paper feed rollers 123, 124, and 125, and then feeds the sheet P to the image-forming section 3 at a predetermined timing.

The paper feeding section 2 also includes a manual feed tray (not shown) to be mounted on the left side surface of the apparatus main body 1*a* shown in FIG. 3 and a pick-up roller 127.

The pick-up roller 127 picks up a sheet P placed in the manual feed tray. The sheet P picked up by the pick-up roller 127 is sent to the sheet transport path by the paper feed rollers 123 and 125, and is fed to the image forming section 3 by the registration roller 126 at a predetermined timing.

The image forming section 3 includes an image forming unit 7, an intermediate transfer belt 31 onto the surface (contact surface) of which a toner image based on image data transmitted from a computer or the like is primary-transferred by the image forming unit 7, and a secondary transfer roller 32 for secondary-transferring the toner image on the intermediate transfer belt 31 onto a sheet P fed from the paper feed cassette 121.

The image forming unit 7 includes a unit 7K for black, a unit 7Y for yellow, a unit 7C for cyan, and a unit 7M for magenta which are arranged in that order from the upstream side (the right side in FIG. 3) toward the downstream side.

A drum-shaped multilayer electrophotographic photoconductor 37 is disposed in the center of each of the units 7K, 7Y, 7C, and 7M so as to be rotatable in the direction indicated by the arrow (clockwise).

A charging portion 39, an exposing portion 38, a developing portion 71, and a charge-neutralizing portion 81 are disposed in that order from the upstream side in the rotation direction.

The charging portion 39 uniformly charges the peripheral surface of the multilayer electrophotographic photoconductor 37 rotated in the direction indicated by the arrow.

The charging portion 39 is not particularly limited as long as it can uniformly charge the peripheral surface of the multilayer electrophotographic photoconductor 37 and may be of non-contact type or contact type.

Examples of the non-contact type include a corona charging device, and examples of the contact type include a charging roller and a charging brush.

In the case where the charging portion 39 includes a charging roller of contact type, the charging roller is not particularly limited as long as it can charge the peripheral surface (surface) of the multilayer electrophotographic photoconductor 37 while being in contact with the multilayer electrophotographic photoconductor 37.

As the charging roller, for example, a charging roller which rotates following the rotation of the multilayer electrophotographic photoconductor 37 while being in contact with the multilayer electrophotographic photoconductor 37 may be used. Furthermore, as the charging roller, for example, a roller at least a surface portion of which is made of a resin may be used.

More specifically, an example of the charging roller includes a metal core rotatably supported around an axis, a resin layer disposed on the metal core, and a voltage-applying portion which applies a voltage to the metal core. In a charging device provided with such a charging roller, by applying a voltage to the metal core by the voltage-applying portion, it is possible to charge the surface of the multilayer electrophotographic photoconductor 37 which is in contact with the metal core with the resin layer therebetween.

The resin constituting the resin layer of the charging roller is not particularly limited as long as the peripheral surface of the multilayer electrophotographic photoconductor 37 can be satisfactorily charged.

Specific examples of the resin used for the resin layer according to the embodiments include a silicone resin, a urethane resin, and a silicone-modified resin.

Furthermore, the resin layer may be incorporated with an inorganic filler.

The voltage to be applied to the charging roller by the voltage-applying portion is preferably a DC voltage only.

The DC voltage to be applied to the multilayer electrophotographic photoconductor by the charging roller is preferably about 600 to about 4,000 V, more preferably about 800 to about 3,000 V, and particularly preferably about 900 to about 2,000 V.

In the case where a DC voltage only is applied to the charging roller, a good image can be formed, compared with the case where an AC voltage or a superimposed voltage obtained by superimposing an AC voltage on a DC voltage is applied.

The exposing portion 38 is a laser scanning unit and irradiates, with a laser beam based on image data inputted from a personal computer (PC) which is a higher-level device, the peripheral surface of the multilayer electrophotographic photoconductor 37 uniformly charged by the charging portion 39 to form an electrostatic latent image on the multilayer electrophotographic photoconductor 37.

The developing portion 71 forms a toner image based on the image data by supplying a toner to the peripheral surface of the multilayer electrophotographic photoconductor 37 on which the electrostatic latent image has been formed.

The toner image is primary-transferred onto the intermediate transfer belt 31.

A cleaning portion 8 cleans the residual toner on the peripheral surface of the multilayer electrophotographic photoconductor 37 after the toner image has been primary-transferred onto the intermediate transfer belt 31.

The charge-neutralizing portion 81 removes a charge from the peripheral surface of the multilayer electrophotographic photoconductor 37 after completion of the primary transfer.

The charge-generating material included in the charge-transport layer as the surface layer or the second charge-generation layer as the surface layer of the multilayer electrophotographic photoconductor 37 absorbs light applied by the charge-neutralizing portion 81 and generates a charge in the charge-transport layer.

The charge generated in the charge-transport layer neutralizes the charge present on the surface of the multilayer electrophotographic photoconductor 37.

Since the charge present on the multilayer electrophotographic photoconductor 37 is neutralized in such a manner, generation of exposure memory is suppressed.

Then, the peripheral surface of the multilayer electrophotographic photoconductor 37 which has been subjected to cleaning treatment by the cleaning portion 8 moves toward the charging portion for new charging treatment and is subjected to charging treatment.

The intermediate transfer belt 31 is an endless belt-shaped rotating member, and travels around a plurality of rollers, such as a driving roller 33, a driven roller 34, a back-up roller 35, and a primary transfer roller 36, such that the surface (contact surface) thereof comes into contact with the peripheral surface of each electrophotographic photoconductor 37.

The intermediate transfer belt 31 is configured to be rotated by a plurality of rollers while being pressed against each multilayer electrophotographic photoconductor 37 by the primary transfer roller 36 arranged facing the multilayer electrophotographic photoconductor 37.

The driving roller 33 is rotated by a driving source, such as a stepping motor, and rotates the intermediate transfer belt 31.

The driven roller 34, the back-up roller 35, and the primary transfer rollers 36 are rotatably provided, and rotate following the rotation of the intermediate transfer belt 31 caused by the driving roller 33.

The rollers 34, 35, and 36 are driven to rotate via the intermediate transfer belt 31 in response to the rotation of the driving roller 33, and support the intermediate transfer belt 31.

The primary transfer roller 36 applies a primary transfer bias having a polarity opposite to the charge polarity of the toner to the intermediate transfer belt 31.

Thereby, the toner images formed on the multilayer electrophotographic photoconductors 37 are transferred (primary-transferred) onto the intermediate transfer belt 31 one after another in a superimposed state, the intermediate transfer belt 31 being driven to go around in the direction indicated by the arrow (counterclockwise) by the drive of the driving roller 33 between the multilayer electrophotographic photoconductors 37 and their corresponding primary transfer rollers 36.

The secondary transfer roller 32 applies a secondary transfer bias having a polarity opposite to the polarity of the toner image to the sheet P.

Thereby, the toner image primary-transferred onto the intermediate transfer belt 31 is transferred to the sheet P between the secondary transfer roller 32 and the back-up roller 35.

As a result, a color image (unfixed toner image) is formed on the sheet P.

The fixing section 4 fixes the transferred image transferred to the sheet P in the image forming section 3, and includes a heating roller 41 which is heated with an electrically heating element, and a pressure roller 42 which is arranged so as to face the heating roller 41 and the peripheral surface of which is pressed against the peripheral surface of the heating roller 41.

The transferred image transferred to the sheet P by the secondary transfer roller 32 in the image forming section 3 is fixed to the sheet P through fixing treatment by heating when the sheet P passes between the heating roller 41 and the pressure roller 42.

The sheet P subjected to the fixing treatment is ejected to the paper ejection section 5.

In the color printer 1 of this embodiment, conveyor rollers 6 are arranged in appropriate places between the fixing section 4 and the paper ejection section 5.

The paper ejection section 5 is formed by recessing the top of the apparatus main body 1*a* of the color printer 1, and a paper output tray 51 for receiving the ejected sheet P is formed at the bottom of the recessed portion.

The color printer 1 forms an image on the sheet P by the image-forming operation described above.

Since the tandem-type image-forming apparatus is provided with multilayer electrophotographic photoconductors according to the hereinabove embodiments as image bearing members, even if charging portions of contact type are used, a good image can be formed, the abrasion loss of the photosensitive layer can be small, and the image-forming apparatus can have high durability.

The present disclosure will be described in more detail below on the basis of Examples.

It is to be understood that the present disclosure is not limited thereto.

EXAMPLE 1

A multilayer electrophotographic photoconductor was produced, in which the charge-generation layer and the charge-transport layer were stacked in that order on an electrically conductive base with an undercoat layer therebetween.

Two parts by mass of titanium oxide subjected to surface treatment with alumina and silica and then subjected to surface treatment with methyl hydrogen polysiloxane by wet dispersion (manufactured by Tayca Corporation, SMT-A (trial product), number-average primary particle size 10 nm) and one part by mass of 6/12/66/610 quarterpolymer polyamide resin (manufactured by Toray Industries, Inc., Amilan CM8000) were subjected to dispersion treatment for 5.0 hours with a bead mill, using a mixed solvent including 10.0 parts by mass of methanol, 1.0 part by mass of butanol, and 1.0 part by mass of toluene. Thereby, an application liquid for formation of undercoat layer was prepared.

The resulting application liquid for formation of undercoat layer was filtrated with a filter having an opening of 5 μm, and then applied by dip coating onto an electrically conductive base, which was a drum-shaped support made of aluminum with a diameter of 30 mm and an overall length of 246 mm.

After the application liquid for formation of undercoat layer was applied, heat treatment was performed at 130° C. for 30 minutes to form an undercoat layer with a thickness of 1.5 μm on the electrically conductive base.

One point five parts by mass of the titanyl phthalocyanine satisfying the conditions (A) and (B) described above (hereinafter, referred to as "K-type titanyl phthalocyanine") and one part by mass of a polyvinyl butyral resin (base resin, manufactured by Denki Kagaku Kogyo K.K., Denka Butyral #6000C) were subjected to dispersion treatment for 2 hours with a bead mill, using a mixture of 40 parts by mass of propylene glycol monomethyl ether and 40 parts by mass of tetrahydrofuran as a dispersion liquid. Thereby, an application liquid for formation of charge-generation layer was prepared.

The resulting application liquid for formation of charge-generation layer was filtrated with a filter having an opening of 3.0 μm, and then applied by dip coating onto the undercoat layer.

After the application liquid was applied, treatment was performed at 50° C. for 5 minutes to form the charge-generation layer with a thickness of 0.3 μm.

The K-type titanyl phthalocyanine was produced following the method disclosed in US Patent Application Publication No. 2007/0111123A1.

The Bragg angle in a Cu—Kα characteristic X-ray diffraction spectrum was measured in accordance with the condition (A) for the K-type titanyl phthalocyanine which was the charge-generating material included in the charge-generation layer.

The Bragg angle in a Cu—Kα characteristic X-ray diffraction spectrum was measured by a method in which 0.3 g of K-type titanyl phthalocyanine was dispersed in 5.0 g of tetrahydrofuran, the resulting dispersion liquid was kept in a sealed container for 7 days under the conditions of temperature 23±1° C. and relative humidity 50 to 60 RH and then placed in a sample holder of an X-ray diffractometer (manufactured by Rigaku Corporation, trade name "RINT 1100"), and measurement was performed.

The measurement conditions are as shown in Table 1.

TABLE 1

| Bragg angle measurement conditions | |
|---|---|
| X-ray tube | Cu |
| Tube voltage (kV) | 40 |
| Tube current (mA) | 30 |
| Start angle (°) | 3.0 |
| Stop angle (°) | 40.0 |
| Scanning speed (°/min) | 10 |

Next, differential scanning calorimetry (DSC) was performed in accordance with the condition (B) on the K-type titanyl phthalocyanine which was the charge-generating material included in the charge-generation layer.

The differential scanning calorimetry (DSC) was performed using a differential scanning calorimeter (manufactured by Rigaku Corporation, trade name "TAS-200 model, DSC8230D").

In the measurement, an aluminum sample pan was used, and the temperature rising rate was set at 20° C./min. Table 2 shows optical characteristics (Bragg angle measurement evaluation results) and thermal characteristics (peak temperature and number of peaks) of the K-type titanyl phthalocyanine produced as described above.

TABLE 2

| | Optical characteristics Bragg angle | Thermal characteristics(DSC) | |
|---|---|---|---|
| Charge-generating material | (2θ ± 0.2) peak evaluation | Temperature (° C.) | Number of peaks |
| K-type titanyl phthalocyanine | ○ | 296 | 1 |

TABLE 2-continued

| Charge-generating material | Optical characteristics Bragg angle (2θ ± 0.2) peak evaluation | Thermal characteristics(DSC) Temperature (° C.) | Number of peaks |
|---|---|---|---|
| Y-type titanyl phthalocyanine | ○ | None | 0 |

○: Has a strong peak at Brag angle 2θ ± 0.2° = 27.2° but no peak at 7.2° and 26.2°.

Subsequently, by dissolving 50.0 parts by mass of a hole-transporting material (HTM-1) represented by the chemical formula below as the charge-transporting material, 0.001 parts by mass of the X-form metal-free phthalocyanine as the charge-generating material, and 100 parts by mass of a binder resin in a solvent including 500 parts by mass of tetrahydrofuran and 200 parts by mass of toluene, an application liquid for formation of charge-transport layer was prepared.

The resulting application liquid for formation of charge-transport layer was promptly applied onto the charge-generation layer by the same method as that for the charge-generation layer, followed by heat treatment at 120° C. for 40 minutes to form the charge-transport layer with a thickness of 20 μm.

As the X-form metal-free phthalocyanine, the X-form metal-free phthalocyanine produced by a known method was used.

In addition to the charge-transport layer formed by applying the application liquid immediately after preparation, the charge-transport layer was also formed by applying the application liquid in the same manner after the application liquid was left to stand for 1.0 hour.

Multilayer electrophotographic photoconductors of Examples 2 to 11 were produced as in Example 1 except that the content of the charge-generating material in the charge-transport layer and the content of the charge-transporting material in the charge-transport layer were changed to those shown in Table 3.

In Examples and Comparative Examples, as the hole-transporting material included in the charge-transport layer, HTM-1 represented by the chemical formula below was used.

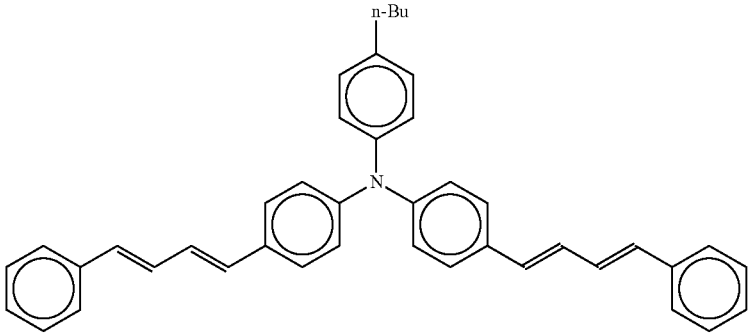

[Hole-transporting material]

Multilayer electrophotographic photoconductors of Examples 12 to 19 were produced as in Example 1 except that the charge-generating material included in the charge-transport layer was changed to the K-type titanyl phthalocyanine described above, and the content thereof was set as shown in Table 3.

Multilayer electrophotographic photoconductors of Comparative Examples 1 to 3 were produced as in Example 1 except that no charge-generating material was included in the charge-transport layer, and the content of the charge-transporting material was set as shown in Table 3.

Multilayer electrophotographic photoconductors of Comparative Examples 4 to 11 were produced as in Example 1 except that the titanyl phthalocyanine having the optical characteristics and thermal characteristics shown in Table 2 (hereinafter referred to as the "Y-type titanyl phthalocyanine") was used as the charge-generating material included in the charge-transport layer, and the content thereof was set as shown in Table 3.

The Y-type titanyl phthalocyanine was produced by a known method, and optical characteristics and thermal characteristics were measured as in Example 1.

Table 2 shows the measurement results of the optical characteristics and thermal characteristics of the Y-type titanyl phthalocyanine.

Multilayer electrophotographic photoconductors of Reference Examples 1 to 3 were produced as in Example 1 except that Y-type titanyl phthalocyanine, the X-form metal-free phthalocyanine, and K-type titanyl phthalocyanine were used as the charge-generating material included in the charge-transport layer, and the content thereof was set as shown in Table 3.

The absorbance was measured at 670 nm and 780 nm for charge-transport layers of the multilayer electrophotographic photoconductors produced in Examples 1 to 19, Comparative Examples 1 to 11, and Reference Examples 1 to 3. The absorbance was measured by a method in which a coating film of the charge-transport layer of the multilayer electrophotographic photoconductor was formed on an aluminum base, the coating film was removed from the aluminum base, and measurement was performed in the usual manner using a spectrophotometer (Hitachi spectrophotometer U-3000).

The multilayer electrophotographic photoconductors produced in Examples and Comparative Examples were each mounted on an apparatus using a negative development process, the apparatus being obtained by modifying a commercially available printer (FS-05300DN manufactured by Kyocera Mita Corporation) provided with a charging roller.

Continuous paper feeding was performed for 1.0 hour, and immediately after this, the exposure memory was evaluated.

As the charging method, a roller charging system to which a DC voltage only was applied was employed.

The initial surface potential of the multilayer electrophotographic photoconductor was set at 420 V.

In this state, after A4 size paper having a 3 cm square solid black image (a white image other than the solid black image) was formed, a uniformly gray image was outputted to the periphery of the drum by the evaluation apparatus.

In the evaluation of exposure memory, the exposure memory in the image-formed copy paper was visually observed and evaluated with the following four criteria:

No generation of exposure memory is observed.

Generation of exposure memory is slightly observed, but there is no problem in use.

Small amount of exposure memory is generated.

Distinct exposure memory is generated.

Regarding the electrical characteristics, the image drum unit was modified, the developing member was removed, and the surface potential and sensitivity were measured with a potential probe (surface potential measurement device Model 244 manufactured by Monroe Electronics Inc.), using a given jig.

The results of evaluation of absorbance and exposure memory in the surface layer of the multilayer electrophotographic photoconductor produced in each of Examples and Comparative Examples are shown in Table 3 below.

TABLE 3

| | | Charge-generating material in Charge transport layer | | Charge-transporting agent in charge transport layer | | Electrical characteristics | | Absorbance of surface layer | | Evaluation of memory | |
|---|---|---|---|---|---|---|---|---|---|---|---|
| | | Type | parts | Type | parts | Charge acceptance (V) | Sensitivity (V) | 670 nm | 780 nm | Immediately after preparation | One hour after preparation |
| Example | 1 | A | 0.001 | HTM-1 | 50 | 605 | 65 | 0.001 | 0.001 | Slightly generated, but at level of no problem | Slightly generated, but at level of no problem |
| | 2 | A | 0.005 | HTM-1 | 50 | 603 | 66 | 0.003 | 0.004 | No generation of memory | No generation of memory |
| | 3 | A | 0.010 | HTM-1 | 50 | 600 | 67 | 0.007 | 0.008 | No generation of memory | No generation of memory |
| | 4 | A | 0.050 | HTM-1 | 50 | 600 | 70 | 0.033 | 0.041 | No generation of memory | No generation of memory |
| | 5 | A | 0.100 | HTM-1 | 50 | 601 | 72 | 0.065 | 0.083 | No generation of memory | No generation of memory |
| | 6 | A | 0.500 | HTM-1 | 50 | 601 | 112 | 0.327 | 0.414 | No generation of memory | No generation of memory |
| | 7 | A | 1.000 | HTM-1 | 50 | 598 | 161 | 0.655 | 0.828 | No generation of memory | No generation of memory |
| | 8 | A | 0.001 | HTM-1 | 30 | 599 | 75 | 0.001 | 0.001 | Slightly generated, but at level of no problem | Slightly generated, but at level of no problem |
| | 9 | A | 0.001 | HTM-1 | 70 | 599 | 56 | 0.001 | 0.001 | Slightly generated, but at level of no problem | Slightly generated, but at level of no problem |
| | 10 | A | 1.000 | HTM-1 | 30 | 600 | 85 | 0.671 | 0.840 | No generation of memory | No generation of memory |
| | 11 | A | 1.000 | HTM-1 | 70 | 599 | 67 | 0.643 | 0.815 | No generation of memory | No generation of memory |
| | 12 | B | 0.001 | HTM-1 | 50 | 600 | 69 | 0.001 | 0.001 | Slightly generated, but at level of no problem | Slightly generated, but at level of no problem |
| | 13 | B | 0.003 | HTM-1 | 50 | 601 | 65 | 0.002 | 0.003 | Slightly generated, but at level of no problem | Slightly generated, but at level of no problem |
| | 14 | B | 0.005 | HTM-1 | 50 | 600 | 64 | 0.003 | 0.004 | No generation of memory | No generation of memory |
| | 15 | B | 0.010 | HTM-1 | 50 | 600 | 69 | 0.007 | 0.009 | No generation of memory | No generation of memory |
| | 16 | B | 0.050 | HTM-1 | 50 | 600 | 70 | 0.033 | 0.043 | No generation of memory | No generation of memory |
| | 17 | B | 0.100 | HTM-1 | 50 | 599 | 74 | 0.064 | 0.081 | No generation of memory | No generation of memory |
| | 18 | B | 0.500 | HTM-1 | 50 | 601 | 118 | 0.324 | 0.414 | No generation of memory | No generation of memory |
| | 19 | B | 1.000 | HTM-1 | 50 | 600 | 166 | 0.651 | 0.831 | No generation of memory | No generation of memory |

TABLE 3-continued

| | | Charge-generating material in Charge transport layer | | Charge-transporting agent in charge transport layer | | Electrical characteristics | | Absorbance of surface layer | | Evaluation of memory | |
|---|---|---|---|---|---|---|---|---|---|---|---|
| | | Type | parts | Type | parts | Charge acceptance (V) | Sensitivity (V) | 670 nm | 780 nm | Immediately after preparation | One hour after preparation |
| Comparative Example | 1 | — | — | HTM-1 | 30 | 600 | 75 | 0.000 | 0.000 | Generation of memory | Generation of memory |
| | 2 | — | — | HTM-1 | 50 | 601 | 65 | 0.000 | 0.000 | Generation of memory | Generation of memory |
| | 3 | — | — | HTM-1 | 70 | 601 | 60 | 0.000 | 0.000 | No generation of memory | Generation of memory |
| | 4 | C | 0.001 | HTM-1 | 50 | 600 | 68 | 0.001 | 0.001 | No generation of memory | Generation of memory |
| | 5 | C | 0.003 | HTM-1 | 50 | 599 | 65 | 0.002 | 0.002 | Slightly generated, but at level of no problem | Generation of memory |
| | 6 | C | 0.005 | HTM-1 | 50 | 599 | 65 | 0.003 | 0.004 | No generation of memory | Generation of memory |
| | 7 | C | 0.010 | HTM-1 | 50 | 598 | 68 | 0.007 | 0.008 | No generation of memory | Generation of memory |
| | 8 | C | 0.050 | HTM-1 | 50 | 600 | 70 | 0.33 | 0.041 | No generation of memory | Generation of memory |
| | 9 | C | 0.100 | HTM-1 | 50 | 600 | 73 | 0.065 | 0.083 | No generation of memory | Generation of memory |
| | 10 | C | 0.500 | HTM-1 | 50 | 599 | 120 | 0.327 | 0.414 | No generation of memory | Generation of memory |
| | 11 | C | 1.000 | HTM-1 | 50 | 601 | 170 | 0.655 | 0.828 | No generation of memory | Generation of memory |
| Reference Example | 1 | C | 2.000 | HTM-1 | 50 | 603 | 600 | 1.300 | 1.651 | Unable to print | Unable to print |
| | 2 | A | 2.000 | HTM-1 | 50 | 602 | 600 | 1.309 | 1.656 | Unable to print | Unable to print |
| | 3 | B | 2.000 | HTM-1 | 50 | 603 | 600 | 1.302 | 1.651 | Unable to print | Unable to print |

As the charge-generating material included in the charge-generation layer of the electrophotographic photoconductor in each of Examples, Comparative Examples, and Reference Examples, K-type titanyl phthalocyanine was used.

Regarding the charge-generating material included in the charge-transport layer of the electrophotographic photoconductor in Examples, Comparative Examples, and Reference Examples, in Table 3, A represents the X-form metal-free phthalocyanine, B represents K-type titanyl phthalocyanine, and C represents Y-type titanyl phthalocyanine.

As is evident from Examples 1 to 19, by using, as the charge-generating material of the charge-generation layer, the X-form metal-free phthalocyanine which has absorption at the wavelength of the charge-neutralizing light or the titanyl phthalocyanine crystal which has absorption at the wavelength of the charge-neutralizing light and which has predetermined optical characteristics and thermal characteristics, by incorporating the charge-generating material into the charge-transport layer, and by setting the content of the charge-generating material in the charge-transport layer at about 0.001 to about 1.0 part by mass relative to 100 parts by mass of the binder resin of the charge-transport layer, the exposure memory generated in the transfer step in the image formation process can be satisfactorily suppressed.

As is also evident from Table 3, in the multilayer electrophotographic photoconductors obtained in Examples 1 to 19, the X-form metal-free phthalocyanine which has absorption at the wavelength of the charge-neutralizing light or the titanyl phthalocyanine crystal which has absorption at the wavelength of the charge-neutralizing light and which has predetermined optical characteristics and thermal characteristics is used as the charge-generating material of the charge-generation layer, and therefore, even in the case where the application liquid for formation of charge-transport layer is applied immediately after preparation or in the case where the application liquid is applied after being left to stand for 1.0 hour after preparation, the exposure memory generated in the transfer step in the image formation process can be satisfactorily suppressed.

The results show that the X-form metal-free phthalocyanine which has absorption at the wavelength of the charge-neutralizing light or the titanyl phthalocyanine crystal which has absorption at the wavelength of the charge-neutralizing light and which has predetermined optical characteristics and thermal characteristics used as the charge-generating material included the charge transportation layer does not cause transformation of crystal form in the application liquid for formation of charge-transport layer and maintains a stable crystal form.

In contrast, in the multilayer electrophotographic photoconductors in Comparative Examples 1 to 3, since the charge-transport layer does not include the charge-generating material, the exposure memory is generated.

In the multilayer electrophotographic photoconductors in Comparative Examples 4 to 11, in the case where the photosensitive layer is formed using the application liquid for formation of charge-transport layer, the application liquid being left to stand for one hour after preparation, the exposure memory cannot be suppressed. The results show that, in Comparative Examples 4 to 11, the Y-type titanyl phthalocyanine which is the charge-generating material included in the charge-transport layer crystallographically transforms to β-type titanyl phthalocyanine when brought into contact with the solvent in the application liquid for formation of charge-transport layer, and therefore, image characteristics and electrical characteristics are degraded.

In the multilayer electrophotographic photoconductors in Reference Examples 1 to 3, since the content of the predetermined charge-generating material in the charge-transport layer exceeded 1.0 part by mass and was 2.0 parts by mass, a sufficient amount of exposure wavelength light did not reach the charge-generation layer, sensitivity in electrical characteristics largely degraded, and it was not possible to print the image.

Having thus described in detail embodiments of the present disclosure, it is to be understood that the subject matter disclosed by the foregoing paragraphs is not to be limited to particular details and/or embodiments set forth in the above description. For example, particular numerical values or ranges are provided by way of illustration for clarity of exposition, and are not intended to limit the possible values or ranges that may be implemented in accordance with the present disclosure. Accordingly, it is understood that many variations of the embodiments and subject matter disclosed herein are possible without departing from the spirit or scope of the present disclosure.

What is claimed is:

1. A multilayer electrophotographic photoconductor comprising:

an electrically conductive base; and a photosensitive layer disposed on the electrically conductive base, wherein the photosensitive layer includes:

a charge-generation layer including a charge-generating material consisting essentially of a titanyl phthalocyanine crystal which satisfies the conditions (A) and (B) below and a base resin, and a charge-transport layer including (i) a charge-transporting material, (ii) the charge-generating material consisting essentially of the titanyl phthalocyanine crystal which satisfies the conditions (A) and (B) below or an X-form metal-free phthalocyanine crystal and (iii) a binder resin, the charge-generation layer and the charge-transport layer being stacked in that order, wherein (A) in a Cu-Kα characteristic X-ray diffraction spectrum, one peak is present at a Bragg angle $2\theta \pm 0.2° = 27.2°$;

wherein (B) in a differential scanning calorimetry, one peak is present in a range of 270° C. to 400° C. except for peaks attributed to vaporization of adsorption water;

wherein, in the charge-transport layer, a ratio of the charge generating material to the charge transporting material is 0.005:50 to 0.01:50 by mass.

2. The multilayer electrophotographic photoconductor according to claim 1, wherein the amount of the charge-generating material included in the charge-transport layer is about 0.005 to about 0.01 part by mass relative to 100 parts by mass of the binder resin or the base resin.

3. An image-forming apparatus comprising:

an image bearing member;

a charging operable portion for charging the surface of the image bearing member;

an exposing portion operable for exposing the surface of the image bearing member to form an electrostatic latent image;

a developing portion operable for developing the electrostatic latent image to form a toner image;

a transferring portion operable for transferring the toner image from the image bearing member to a transfer-receiving medium; and a charge-neutralizing portion operable for neutralizing a charge from the surface of the image bearing member, wherein the image bearing member is the multilayer electrophotographic photoconductor according to claim 2.

4. An image-forming apparatus comprising:

an image bearing member;

a charging portion operable for charging the surface of the image bearing member;

an exposing portion operable for exposing the surface of the image bearing member to form an electrostatic latent image;

a developing portion operable for developing the electrostatic latent image to form a toner image;

a transferring portion operable for transferring the toner image from the image bearing member to a transfer-receiving medium; and a charge-neutralizing portion operable for neutralizing a charge from the surface of the image bearing member, wherein the image bearing member is the multilayer electrophotographic photoconductor according to claim 1.

5. The image-forming apparatus according to claim 4, wherein the charge-neutralizing light of the charge-neutralizing portion has a wavelength that is absorbed by the charge-generating material included in the charge-transport layer.

6. The multilayer electrophotographic photoconductor according to claim 1, wherein the charge-transporting material is HTM-1 represented by the chemical formula below:

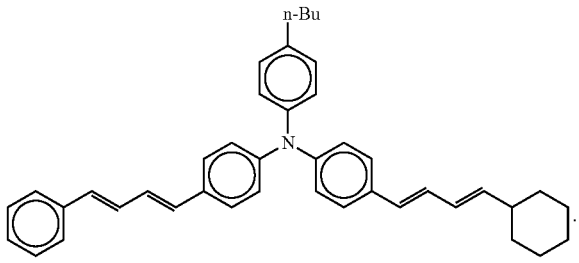

* * * * *